US010633611B2

(12) United States Patent
Ido et al.

(10) Patent No.: US 10,633,611 B2
(45) Date of Patent: Apr. 28, 2020

(54) WATER-SOLUBLE METAL WORKING OIL AGENT

(71) Applicant: SUMITOMO SEIKA CHEMICALS CO., LTD., Kako-gun, Hyogo (JP)

(72) Inventors: Toru Ido, Himeji (JP); Makiko Kawano, Himeji (JP); Makoto Katou, Tokyo (JP)

(73) Assignee: SUMITOMO SEIKA CHEMICALS CO., LTD., Hyogo (JP)

( * ) Notice: Subject to any disclaimer, the term of this patent is extended or adjusted under 35 U.S.C. 154(b) by 35 days.

(21) Appl. No.: 14/778,769

(22) PCT Filed: Dec. 18, 2013

(86) PCT No.: PCT/JP2013/083948

§ 371 (c)(1),
(2) Date: Dec. 2, 2015

(87) PCT Pub. No.: WO2014/155870

PCT Pub. Date: Oct. 2, 2014

(65) Prior Publication Data

US 2016/0083670 A1 Mar. 24, 2016

(30) Foreign Application Priority Data

Mar. 26, 2013 (JP) ..... 2013-063377

(51) Int. Cl.
*B24B 1/00* (2006.01)
*C10M 145/28* (2006.01)
*C10M 173/02* (2006.01)

(52) U.S. Cl.
CPC ..... *C10M 145/28* (2013.01); *C10M 173/02* (2013.01); *C10M 2209/103* (2013.01);
(Continued)

(58) Field of Classification Search
CPC ..... C10N 2240/401; C10M 173/00
(Continued)

(56) References Cited

U.S. PATENT DOCUMENTS 3,227,652 A * 1/1966 Ackerman ..... C10M 173/00 508/579
3,635,823 A * 1/1972 Latos ..... C10L 1/14 252/400.21

(Continued)

FOREIGN PATENT DOCUMENTS

CN 101003764 A 7/2007
EP 0321370 A1 6/1989

(Continued)

OTHER PUBLICATIONS

Jana Herzberger et al., "Polymerization of Ethylene Oxide, Propylene Oxide, and Other Alkylene Oxides: Synthesis, Novel Polymer Architectures, and Bioconjugation", Chemical Reviews, vol. 116, No. 4.

(Continued)

*Primary Examiner* — Joseph J Hail
*Assistant Examiner* — Shantese L McDonald
(74) *Attorney, Agent, or Firm* — Knobbe, Martens, Olson & Bear, LLP

(57) ABSTRACT

A water-soluble metal working oil agent which can be prevented from being scattered in the form of mists for a long period when used for the cutting processing, grinding processing and the like of metallic materials is provided. A method for producing the water-soluble metal working oil agent is described. The water-soluble metal working oil agent includes a polyalkylene oxide having a weight average molecular weight of 100,000 to 1,000,000 and water.

12 Claims, 1 Drawing Sheet

(52) U.S. Cl.
CPC . *C10M 2209/104* (2013.01); *C10M 2209/105* (2013.01); *C10M 2209/106* (2013.01); *C10N 2220/021* (2013.01); *C10N 2220/022* (2013.01); *C10N 2240/40* (2013.01); *C10N 2240/401* (2013.01)

(58) Field of Classification Search
USPC ..... 451/28, 36
See application file for complete search history.

(56) References Cited

U.S. PATENT DOCUMENTS

| | | | | |
|---|---|---|---|---|
| 3,668,237 | A * | 6/1972 | Cyba | C07F 9/3211 106/18.2 |
| 3,853,772 | A * | 12/1974 | Adams | C10M 1/08 508/156 |
| 6,333,422 | B1 | 12/2001 | Sohn et al. | |
| 2007/0167335 | A1 | 7/2007 | Combs et al. | |
| 2007/0167336 | A1 | 7/2007 | Combs et al. | |

FOREIGN PATENT DOCUMENTS

| | | | |
|---|---|---|---|
| EP | 0441266 | A1 | 8/1991 |
| EP | 1749866 | A1 | 2/2007 |
| JP | 57-36195 | A | 2/1982 |
| JP | H1-259119 | A | 10/1989 |
| JP | 6-88089 | A | 3/1994 |
| JP | 2004-18758 | A | 1/2004 |
| JP | 2004-506739 | A | 3/2004 |
| JP | 2005-343955 | A | 12/2005 |
| JP | 2011-231304 | A | 11/2011 |
| WO | WO 93/24601 | A1 | 12/1993 |

OTHER PUBLICATIONS

Extended European Search Report for Application No. 13880244.2, dated Sep. 27, 2016.
International Search Report for International Application No. PCT/JP2013/083948, dated Feb. 4, 2014, in 2 pages.
Office Action dated Feb. 10, 2017, in connection with Counterpart Taiwanese Patent Application No. 102148261.
Office Action received in Japanese Patent Application No. 2015-507962 dated Nov. 28, 2017.
Office Action received in connection with corresponding European Patent Application No. 13 880 244.2 dated Aug. 29, 2018.
Water-Soluble Resins-Unique Resins for Binding, Lubricity, Adhesion and Emollient Performance, Dow Chemical Company, Mar. 1, 2002, pp. 1-24.

* cited by examiner

WATER-SOLUBLE METAL WORKING OIL AGENT

CROSS-REFERENCE TO RELATED APPLICATIONS

This application is the U.S. National Phase under 35 U.S.C. § 371 of International Application PCT/JP2013/083948, filed Dec. 18, 2013, which claims priority to JP Application No. 2013-063377, filed Mar. 26, 2013.

TECHNICAL FIELD

The present invention relates to a water-soluble metal working oil which can be inhibited from being scattered in the form of a mist for a long period of time when used for cutting processing, grinding processing and the like of metallic materials, and a method for producing the water-soluble metal working oil.

BACKGROUND ART

In cutting processing, grinding processing and the like of metallic materials, metal working oils have been heretofore used for the purpose of lubrication, cooling and the like between a metallic material to be processed and a processing tool rotating at a high speed. As metal working oils, water-insoluble metal working oils mainly composed of mineral oil and so on, and water-soluble metal working oils formed by diluting mineral oil, a surfactant and so on with water are known.

In recent years, water-soluble metal working oils have come into wide use because water-insoluble metal working oils have the disadvantage that they easily catch fire. The rotation speed of processing tools in cutting processing, grinding processing and the like of metallic materials have been increasingly enhanced for improvement of processing efficiency. Accordingly, shearing stress, frictional heat and the like that are applied to metal working oils have further increased. When large shearing stress or frictional heat is applied to a metal working oil, the metal working oil is partially micronized and thermally decomposed, so that the metal working oil is easily scattered around in the form of a mist. Particularly, water-soluble metal working oils generally have a lower viscosity, and thus may be more easily scattered in the form of a mist as compared to water-insoluble metal working oils.

When a mist of a metal working oil is scattered, a processing machine, a product and so on may be contaminated by the metal working oil. Operators may lose their health when a mist of a metal working oil is taken in the bodies of the operators through their respiratory organs. Under these conditions, it is desired to develop a water-soluble metal working oil which can be effectively inhibited from being scattered in the form of a mist when used for cutting processing, grinding processing and the like of metallic materials. For example, Patent Document 1 discloses a water-soluble metal working oil containing a polyalkylene oxide having an average molecular weight of more than 1,000,000, etc. in view of suppressing scattering of a mist.

PRIOR ART DOCUMENT

Patent Document

Patent Document 1: International Patent Publication No. WO 93/24601

SUMMARY OF THE INVENTION

Problems to be Solved by the Invention

As a result of extensively conducting studies by the present inventors, however, it has been found that when a water-soluble metal working oil as disclosed in, for example, Patent Document 1 is used for cutting processing, grinding processing and the like of metallic materials, there is a new problem that although a mist of the water-soluble metal working oil is suppressed immediately after the start of using the water-soluble metal working oil, scattering of the mist is increased as the water-soluble metal working oil is repeatedly used. It has become evident that particularly in metal working where high shearing stress is applied, the mist scattering suppression effect is easily reduced, so that a new water-soluble metal working oil may be required to be frequently supplied.

The present invention has been devised in view of the above-mentioned problems. Thus, a main object of the present invention is to provide a water-soluble metal working oil which can be inhibited from being scattered in the form of a mist for a long period of time when used for cutting processing, grinding processing and the like of metallic materials, and a method for producing the water-soluble metal working oil.

Means for Solving the Problem

The present inventors have extensively conducted studies for solving problems as described above. As a result, the present inventors have found that when a water-soluble metal working oil containing a polyalkylene oxide having a weight average molecular weight of 100,000 to 1,000,000, and water is used for cutting processing, grinding processing and the like of metallic materials, scattering of a mist of the water-soluble metal working oil is suppressed for a long period of time. The present invention has been completed by further conducting studies based on these findings.

The present invention provides water-soluble metal working oils and a method for production thereof, which have the following aspects.

Item 1. A water-soluble metal working oil containing a polyalkylene oxide having a weight average molecular weight of 100,000 to 1,000,000, and water.

Item 2. The water-soluble metal working oil according to item 1, wherein the carbon number of a monomer unit that forms the polyalkylene oxide is 2 to 4.

Item 3. The water-soluble metal working oil according to item 1 or 2, wherein the polyalkylene oxide contains at least one monomer unit selected from the group consisting of an ethylene oxide unit, a propylene oxide unit and a butylene oxide unit.

Item 4. The water-soluble metal working oil according to any one of items 1 to 3, wherein the polyalkylene oxide is at least one selected from the group consisting of a polyethylene oxide, a polypropylene oxide, a polybutylene oxide, an ethylene oxide-propylene oxide copolymer, an ethylene oxide-butylene oxide copolymer and a propylene oxide-butylene oxide copolymer.

Item 5. The water-soluble metal working oil according to any one of items 1 to 4, wherein the content of the polyalkylene oxide is 0.1 to 5% by mass.

Item 6. The water-soluble metal working oil according to any one of items 1 to 5, wherein the viscosity is 5 to 10,000 mPa·s.

Item 7. The water-soluble metal working oil according to any one of items 1 to 6, wherein the water-soluble metal working oil is used for cutting processing or grinding processing of a metallic material.

Item 8. A method for producing the water-soluble metal working oil according to any one of items 1 to 7, the method including the step of: mixing a polyalkylene oxide with water, the polyalkylene oxide having a weight average molecular weight of 100,000 to 1,000,000.

Item 9. Use of a water-soluble composition for metal working, the water-soluble composition containing a polyalkylene oxide having a weight average molecular weight of 100,000 to 1,000,000, and water.

Advantages of the Invention

According to the present invention, there can be provided a water-soluble metal working oil which can be inhibited from being scattered in the form of a mist for a long period of time when used for cutting processing, grinding processing and the like of metallic materials, and a method for producing the water-soluble metal working oil.

EMBODIMENTS OF THE INVENTION

Figure 1:
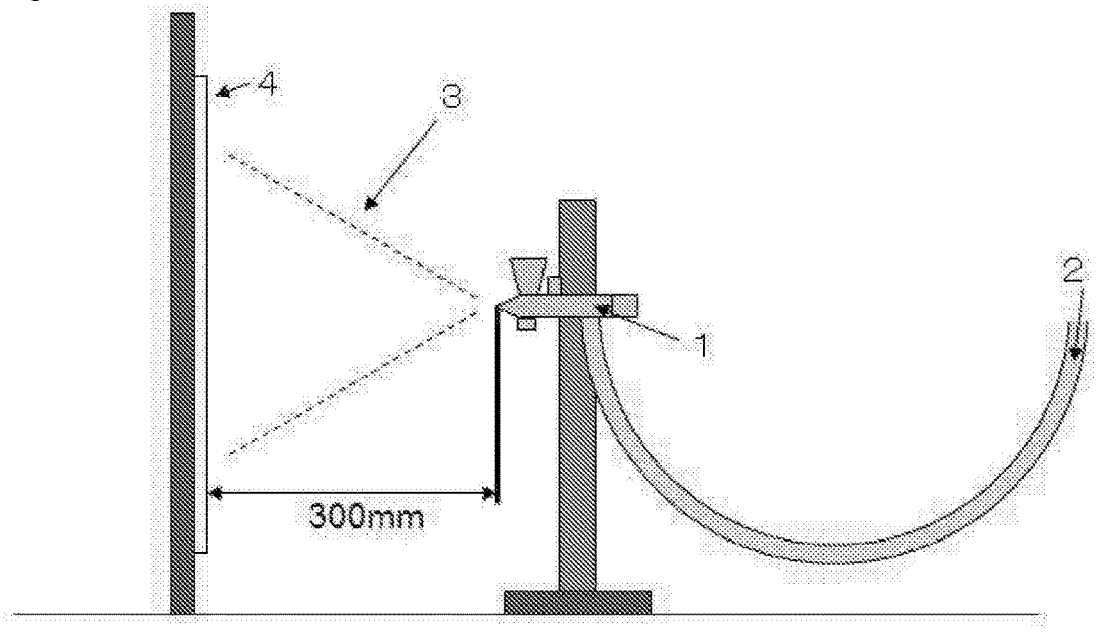
FIG. 1 is a schematic view of a device that measures a scattering diameter of a water-soluble metal working oil.

A water-soluble metal working oil according to the present invention contains a polyalkylene oxide having a weight average molecular weight of 100,000 to 1,000,000, and water. Hereinafter, the water-soluble metal working oil according to the present invention, a method for producing the water-soluble metal working oil, and a method for processing of metal using the water-soluble metal working oil.

1. Water-Soluble Metal Working Oil

The water-soluble metal working oil according to the present invention contains a polyalkylene oxide having a weight average molecular weight of 100,000 to 1,000,000, and water. The water-soluble metal working oil according to the present invention is a water-soluble composition containing a polyalkylene oxide having a weight average molecular weight of 100,000 to 1,000,000, and water, and is used for metal working.

The polyalkylene oxide is not particularly limited as long as it has a weight average molecular weight in the above-mentioned range, and contains an alkylene oxide as a monomer unit. For suppressing scattering of a mist of the water-soluble metal working oil for a long period of time when the water-soluble metal working oil is used for cutting processing, grinding processing or the like, the carbon number of the monomer unit that forms the polyalkylene oxide is preferably about 2 to 4, more preferably about 2 to 3.

For suppressing scattering of a mist of the water-soluble metal working oil for a long period of time, the alkylene oxide unit is preferably an aliphatic alkylene oxide unit with a carbon number 2 to 4, such as an ethylene oxide unit, a propylene oxide unit or a butylene oxide unit, more preferably an aliphatic alkylene oxide unit with a carbon number of 2 to 3, such as an ethylene oxide unit or a propylene oxide unit. Examples of the propylene oxide unit include a 1,2-propylene oxide unit and a 1,3-propylene oxide unit. Examples of the butylene oxide unit include a 1,2-butylene oxide unit, a 2,3-butylene oxide unit and an isobutylene oxide unit. One of these alkylene oxide units may be contained alone, or two or more of these alkylene oxide units may be contained. The polyalkylene oxide may be a block copolymer or random copolymer containing at least one of these alkylene oxide units.

Specific examples of especially preferred polyalkylene oxides include polyethylene oxides, polypropylene oxides, polybutylene oxides, ethylene oxide-propylene oxide copolymers, ethylene oxide-butylene oxide copolymers and propylene oxide-butylene oxide copolymers. These copolymers may be either block copolymers or random copolymers. The polyalkylene oxides may be used alone, or may be used in combination of two or more thereof.

The weight average molecular weight of the polyalkylene oxide is about 100,000 to 1,000,000. In the present invention, the water-soluble metal working oil contains a polyalkylene oxide having such a specific molecular weight, and thus scattering of a mist of the water-soluble metal working oil can be suppressed for a long period of time. Details of the mechanism in which scattering of a mist of the water-soluble metal working oil is suppressed is not necessarily evident, but for example, it may be considered as follows. That is, it is considered that in the water-soluble metal working oil according to the present invention, the weight average molecular weight of the polyalkylene oxide is in a specific range of about 100,000 to 1,000,000, and therefore as compared to, for example, a polyalkylene oxide having a weight average molecular weight of more than 1,000,000, the molecular chain of the polyalkylene oxide is hard to be cut even when shearing stress is applied for a long period of time, so that micronization of the water-soluble metal working oil is suppressed. Further, it is considered that in the water-soluble metal working oil according to the present invention, the polyalkylene oxide has a larger weight average molecular weight as compared to a polyalkylene oxide having a weight average molecular weight of less than 100,000, and therefore the water-soluble metal working oil is hard to be micronized.

For improving the mist scattering suppression effect for the water-soluble metal working oil, the weight average molecular weight of the polyalkylene oxide is preferably about 130,000 to 950,000, more preferably about 300,000 to 750,000. As described above, when the weight average molecular weight of the polyalkylene oxide is less than 100,000, the mist scattering suppression effect may be considerably reduced when the water-soluble metal working oil is used for cutting processing, grinding processing or the like. On the other hand, when the weight average molecular weight of the polyalkylene oxide is more than 1,000,000, the mist scattering suppression effect is not retained, and is easily reduced when shearing stress is applied to the water-soluble metal working oil for a long period of time. The weight average molecular weight of the polyalkylene oxide is a value measured by gel permeation chromatography (GPC) using a polyethylene oxide as a standard sample.

The polyalkylene oxide may be produced by a previously known method, or a commercial product may be used as the polyalkylene oxide. Examples of the commercial product of the polyalkylene oxide include PEO-L2Z (trade name) (weight average molecular weight: 100,000 to 150,000), PEO-1 (trade name) (weight average molecular weight: 150,000 to 400,000), PEO-2 (trade name) (weight average molecular weight: 400,000 to 600,000) and PEO-3 (trade name) (weight average molecular weight: 600,000 to 1,000,000), each of which is manufactured by Sumitomo Seika Chemicals Company, Limited. "PEO" is a registered trademark possessed by Sumitomo Seika Chemicals Company, Limited.

In the water-soluble metal working oil according to the present invention, the content of the polyalkylene oxide is not particularly limited, but it is preferably about 0.1 to 5% by mass, more preferably about 0.3 to 4.8% by mass for suppressing scattering of a mist of the water-soluble metal working oil for a long period of time.

The viscosity of the water-soluble metal working oil is not particularly limited, and it is normally about 5 to 10,000 mPa·s, preferably about 7 to 2,000 mPa·s. The viscosity of the water-soluble metal working oil is a value obtained by measuring the viscosity at 25° C. after 3 minutes with the rotation speed set to 60 per minute using a B-type rotary viscometer (B-type viscometer manufactured by TOKIMEC, Inc.). As a rotor to be used for the measurement, rotor No. 1 is used for the viscosity of less than 80 mPa·s, rotor No. 2 is used for the viscosity of not less than 80 mPa·s and less than 400 mPa·s, rotor No. 3 is used for the viscosity of not less than 400 mPa·s and less than 1,600 mPa·s, and rotor No. 4 is used for the viscosity of not less than 1,600 mPa·s.

Water contained in the water-soluble metal working oil according to the present invention is not particularly limited, and examples thereof include industrial water, city water, purified water, ion-exchanged water and pure water. The content of water contained in the water-soluble metal working oil is not particularly limited as long as the water-soluble metal working oil can serve as a lubricant or a coolant in cutting processing, grinding processing or the like of a metallic material, but it is normally about 30 to 99% by mass, preferably about 50 to 95% by mass, more preferably about 70 to 95% by mass.

The water-soluble metal working oil according to the present invention generally contains a base oil in addition to the polyalkylene oxide. The base oil is not particularly limited, and may be a base oil that is generally used in water-soluble metal working oils, and examples thereof include base oils that are used in water-soluble cutting oils of type A1, type A2 or type A3 as described in JIS K2241-2000. The content of the base oil is not particularly limited, and may be normally about 0.01 to 20% by mass, preferably about 0.1 to 15% by mass.

The water-soluble metal working oil according to the present invention may further contain additives as necessary. The additives are not particularly limited, and examples thereof include additives that are contained in known water-soluble metal working oils. Examples of the additive include lubricants, extreme-pressure additives, antifoaming agents, antioxidants, antirust agents, anticorrosives, preservatives and surfactants. The additives may be used alone, or may be used in combination of two or more thereof.

The lubricant is not particularly limited, and examples thereof include known lubricants that are used in water-soluble metal working oils. Specific examples of the lubricant include mineral oils, synthetic oils, aliphatic carboxylic acids with a carbon number of 6 or more, and aliphatic dicarboxylic acids with a carbon number of 6 or more. The lubricants may be used alone, or may be used in combination of two or more thereof. When the water-soluble metal working oil contains a lubricant, the content thereof is not particularly limited, and may be normally about 0.01 to 20% by mass, preferably about 0.1 to 15% by mass.

The extreme-pressure additive is not particularly limited, and examples thereof include known extreme-pressure additives that are used in water-soluble metal working oils. Specific examples of the extreme-pressure additive include chlorine-based extreme-pressure additives, sulfur-based extreme-pressure additives and phosphor-based extreme-pressure additives. Examples of the chlorine-based extreme-pressure additive include chlorinated paraffins, chlorinated fatty acids and chlorinated fatty oils. Examples of the sulfur-based extreme-pressure additive include olefin sulfides, lard sulfides, alkyl polysulfides and fatty acid sulfides. Examples of the phosphor-based extreme-pressure additive include phosphoric acid ester (salt)-based extreme-pressure additives, phosphorous acid ester (salt)-based extreme-pressure additives, thiophosphoric acid ester (salt)-based extreme-pressure additives, phosphine-based extreme-pressure additives and tricresyl phosphate. The extreme-pressure additives may be used alone, or may be used in combination of two or more thereof. When the water-soluble metal working oil contains an extreme-pressure additive, the content thereof is not particularly limited, and may be normally about 0.01 to 20% by mass, preferably about 0.1 to 15% by mass.

The antifoaming agent is not particularly limited, and examples thereof include known antifoaming agents that are used in water-soluble metal working oils. Specific examples of the antifoaming agent include silicon-based antifoaming agents such as methyl silicone oils, fluorosilicone oils, dimethyl polysiloxanes and modified polysiloxanes. The antifoaming agents may be used alone, or may be used in combination of two or more thereof. When the water-soluble metal working oil contains an antifoaming agent, the content thereof is not particularly limited, and may be normally about 0.01 to 10% by mass, preferably about 0.1 to 5% by mass.

The preservative is not particularly limited, and examples thereof include known preservatives that are used in water-soluble metal working oils. Examples of the preservative include triazine-based preservatives, isothiazoline-based preservatives and phenol-based preservatives. Specific examples of the triazine-based preservative include hexahydro-1,3,5-tris(2-hydroxyethyl)-1,3,5-triazine. Specific examples of the isothiazoline-based preservative include 1,2-benzoisothiazoline-3-one, 5-chloro-2-methyl-4-isothiazoline-3-one and 2-methyl-isothiazoline-3-one. Specific examples of the phenol-based preservative include orthophenylphenol and 2,3,4,6-tetrachlorophenol. The preservatives may be used alone, or may be used in combination of two or more thereof. When the water-soluble metal working oil contains a preservative, the content thereof is not particularly limited, and may be normally about 0.01 to 10% by mass, preferably about 0.1 to 5% by mass.

The anticorrosive is not particularly limited, and examples thereof include known anticorrosives that are used in water-soluble metal working oils. Examples of the anticorrosive include triazoles. Specific examples of the triazole include benzotriazole, tolyltriazole and 3-aminotriazole. The anticorrosives may be used alone, or may be used in combination of two or more thereof. When the water-soluble metal working oil contains an anticorrosive, the content thereof is not particularly limited, and may be normally about 0.01 to 10% by mass, preferably about 0.1 to 5% by mass.

The antirust agent is not particularly limited, and examples thereof include known antirust agents that are used in water-soluble metal working oils. Examples of the antirust agent include organic carboxylic acids and organic amines. Specific examples of the organic carboxylic acid include dimethyloctanoic acid, pelargonic acid, sebacic acid and dodecanedioic acid. Specific examples of the organic amine include alkanolamines, alkyl alkanolamines and alkyl amines. The antirust agents may be used alone, or may be used in combination of two or more thereof. When the water-soluble metal working oil contains an antirust agent, the content thereof is not particularly limited, and may be normally about 0.01 to 10% by mass, preferably about 0.1 to 5% by mass.

The surfactant is not particularly limited, and examples thereof include known surfactants that are used in water-soluble metal working oils. Examples of the surfactant include anionic surfactants such as fatty acid amine soaps, petroleum sulfonates, sulfated oils, alkyl sulfonamide carboxylic acid salts and carboxylated fats and oils; and nonionic surfactants such as sorbitan fatty acid esters, polyoxyethylene sorbitan fatty acid esters, propylene glycol fatty acid esters, polyethylene glycol fatty acid esters, polyoxyethylene alkyl ethers, polyoxyethylene alkyl phenyl ethers and fatty acid alkylolamides. The surfactants may be used alone, or may be used in combination of two or more thereof. When the water-soluble metal working oil contains a surfactant, the content thereof is not particularly limited, and may be normally about 0.01 to 10% by mass, preferably about 0.1 to 5% by mass.

2. Method for Producing Water-Soluble Metal Working Oil

The water-soluble metal working oil according to the present invention can be produced by mixing a polyalkylene oxide having a weight average molecular weight of 100,000 to 1,000,000, and water, and usually a general base oil as described above is further mixed. In the method for producing the water-soluble metal working oil according to the present invention, at least one of the above-mentioned additives may be mixed as necessary. The method for mixing a polyalkylene oxide, water, a base oil and an additive to be used as necessary is not particularly limited, and the water-soluble metal working oil can be easily produced by, for example, adding the polyalkylene oxide, the base oil, and the additive as necessary to water so as to achieve the above-mentioned contents, and stirring the mixture at normal temperature and normal pressure.

3. Method for Processing of Metal

In the method for processing of metal according to the present invention, processing is performed while the water-soluble metal working oil according to the present invention is kept in contact with the processing part of a metallic material to be processed. More specifically, processing is performed while the water-soluble metal working oil according to the present invention is supplied to a processing tool rotating at a high speed and a processing object part of a metallic material to improve lubricity of the processing object part, and the metallic material is cooled to remove frictional heat. According to the method for processing of metal according to the present invention, scattering of a mist of the water-soluble metal working oil which is generated by the processing tool rotating at a high speed can be suppressed for a long period of time. Accordingly, contamination of a working environment by the water-soluble metal working oil can be effectively suppressed.

The metallic material to be processed is not particularly limited, and examples thereof include iron, titanium, aluminum, magnesium, copper, nickel, chromium, manganese, molybdenum, tungsten, gold, silver, platinum and alloys containing at least one of these metals.

The processing method is not particularly limited, and examples thereof include cutting processing and grinding processing. Specific examples of the cutting processing include machining processing, drilling processing, boring processing, milling processing and gear cutting processing. Examples of the grinding processing include internal grinding. The water-soluble metal working oil according to the present invention is effectively inhibited from being scattered in the form of a mist. Accordingly, the water-soluble metal working oil according to the present invention can be particularly suitably used for processing methods such as machining processing and milling processing where a mist is particularly easily scattered among the above-mentioned processing methods. The processing tool to be used for metal processing is not particularly limited, and examples thereof include drills, bites, milling cutters, end mills, reamers, hobs, pinion cutters, dies, broaches and abrasive wheels. The material that forms the processing tool is not particularly limited, and examples thereof include steel, ultrahard alloys, ceramics, cermets, diamond and cubic boron nitride.

In the method for processing of metal according to the present invention, processing is performed while the water-soluble metal working oil according to the present invention is supplied to the processing object part of the metallic material, and thus the lubricity of the processing object part can be improved to remove heat generated by friction. Further, the water-soluble metal working oil according to the present invention can be repeatedly used for a long period of time because scattering of a mist during processing is effectively suppressed.

EXAMPLES

Hereinafter, the present invention will be described in detail by showing examples and comparative examples. However, the present invention is not limited to examples.

Example 1

A commercially available metal cutting oil (water-soluble cutting oil manufactured by AZ CO., LTD) (25 g) was mixed with 475 g of water, 5.0 g of a polyethylene oxide (PEO-1 (trade name) manufactured by Sumitomo Seika Chemicals Company, Limited; weight average molecular weight: 300,000) was added thereto, and the mixture was stirred in a jar tester (Jar Tester MJS-8S manufactured by Miyamoto Riken Ind. Co., Ltd.) for 3 hours to obtain 505.0 g of a water-soluble metal working oil (content of polyethylene oxide: 1.0% by mass; viscosity: 7.4 mPa·s). The weight average molecular weight of the polyethylene oxide and the viscosity of the water-soluble metal working oil were measured in accordance with the following methods. The same applies for other examples and comparative examples.

<Measurement of Weight Average Molecular Weight>

The weight average molecular weight of the polyalkylene oxide was measured using a gel permeation chromatograph (HLC-8220 GPC manufactured by TOSOH CORPORATION). Two pieces of Shodex OHpack SB-804 HQ (manufactured by Showa Denko K.K.) were connected in tandem, and used as a column. The column temperature was 30° C., a 0.02 mass % aqueous $NaNO_3$ solution was used as a mobile phase, and the flow rate was 1.0 mL/min. The weight average molecular weight was calculated using a polyethylene oxide as a standard sample under the above-mentioned conditions.

<Measurement of Viscosity>

The viscosity of the water-soluble metal working oil is a value obtained by measuring the viscosity at 25° C. after 3 minutes with the rotation speed set to 60 per minute using a B-type rotary viscometer (B-type viscometer manufactured by TOKIMEC, Inc.). As a rotor used for the measurement, rotor No. 1 was used for the viscosity of less than 80 mPa·s, rotor No. 2 was used for the viscosity of not less than 80 mPa·s and less than 400 mPa·s, rotor No. 3 was used for the viscosity of not less than 400 mPa·s and less than 1,600 mPa·s, and rotor No. 4 was used for the viscosity of not less than 1,600 mPa·s.

Example 2

Except that the use amount of the polyethylene oxide (PEO-1 (trade name) manufactured by Sumitomo Seika Chemicals Company, Limited; weight average molecular weight: 300,000) was changed to 12.5 g from 5.0 g in Example 1, the same procedure as in Example 1 was carried out to obtain 512.5 g of a water-soluble metal working oil (content of polyethylene oxide: 2.4% by mass; viscosity: 20.6 mPa·s).

Example 3

Except that 5.0 g of the polyethylene oxide (PEO-1 (trade name) manufactured by Sumitomo Seika Chemicals Company, Limited; weight average molecular weight: 300,000) in Example 1 was changed to 2.5 g of a polyethylene oxide (PEO-3 (trade name) manufactured by Sumitomo Seika Chemicals Company, Limited; weight average molecular weight: 750,000), the same procedure as in Example 1 was carried out to obtain 502.5 g of a water-soluble metal working oil (content of polyethylene oxide: 0.5% by mass; viscosity: 8.6 mPa·s).

Example 4

Except that the use amount of the polyethylene oxide (PEO-3 (trade name) manufactured by Sumitomo Seika Chemicals Company, Limited; weight average molecular weight: 750,000) was changed to 5.0 g from 2.5 g in Example 3, the same procedure as in Example 3 was carried out to obtain 505.0 g of a water-soluble metal working oil (content of polyethylene oxide: 1.0% by mass; viscosity: 22.6 mPa·s).

Example 5

Except that the use amount of the polyethylene oxide (PEO-3 (trade name) manufactured by Sumitomo Seika Chemicals Company, Limited; weight average molecular weight: 750,000) was changed to 12.5 g from 2.5 g in Example 3, the same procedure as in Example 3 was carried out to obtain 512.5 g of a water-soluble metal working oil (content of polyethylene oxide: 2.4% by mass; viscosity: 252 mPa·s).

Example 6

Except that the use amount of the polyethylene oxide (PEO-3 (trade name) manufactured by Sumitomo Seika Chemicals Company, Limited; weight average molecular weight: 750,000) was changed to 22.5 g from 2.5 g in Example 3, the same procedure as in Example 3 was carried out to obtain 522.5 g of a water-soluble metal working oil (content of polyethylene oxide: 4.3% by mass; viscosity: 4660 mPa·s).

Example 7

Except that 5.0 g of the polyethylene oxide (PEO-1 (trade name) manufactured by Sumitomo Seika Chemicals Company, Limited; weight average molecular weight: 300,000) in Example 1 was changed to 25.0 g of a polyethylene oxide (PEO-L2Z (trade name) manufactured by Sumitomo Seika Chemicals Company, Limited; weight average molecular weight: 130,000), the same procedure as in Example 1 was carried out to obtain 525.0 g of a water-soluble metal working oil (content of polyethylene oxide: 4.8% by mass; viscosity: 107 mPa·s).

Example 8

Except that the polyethylene oxide (PEO-3 (trade name) manufactured by Sumitomo Seika Chemicals Company, Limited; weight average molecular weight: 750,000) in Example 5 was changed to a polyethylene oxide (PEO-3 (trade name) manufactured by Sumitomo Seika Chemicals Company, Limited; weight average molecular weight: 950,000), the same procedure as in Example 5 was carried out to obtain 512.5 g of a water-soluble metal working oil (content of polyethylene oxide: 2.4% by mass; viscosity: 232 mPa·s).

Comparative Example 1

Except that 5.0 g of the polyethylene oxide (PEO-1 (trade name) manufactured by Sumitomo Seika Chemicals Company, Limited; weight average molecular weight: 300,000) in Example 1 was not used, the same procedure as in Example 1 was carried out to obtain 500 g of a water-soluble metal working oil (viscosity: 3.2 mPa·s). In the following evaluation tests, the results of evaluation of this water-soluble metal working oil were used as a blank.

Comparative Example 2

Except that 5.0 g of the polyethylene oxide (PEO-1 (trade name) manufactured by Sumitomo Seika Chemicals Company, Limited; weight average molecular weight: 300,000) in Example 1 was changed to 2.5 g of a polyethylene oxide (PEO-4 (trade name) manufactured by Sumitomo Seika Chemicals Company, Limited; weight average molecular weight: 1,300,000), the same procedure as in Example 1 was carried out to obtain 502.5 g of a water-soluble metal working oil (content of polyethylene oxide: 0.5% by mass; viscosity: 9.0 mPa·s).

Comparative Example 3

Except that the use amount of the polyethylene oxide (PEO-4 (trade name) manufactured by Sumitomo Seika Chemicals Company, Limited; weight average molecular weight: 1,300,000) was changed to 5.0 g from 2.5 g in Comparative Example 2, the same procedure as in Comparative Example 2 was carried out to obtain 505.0 g of a water-soluble metal working oil (content of polyethylene oxide: 1.0% by mass; viscosity: 22.4 mPa·s).

Comparative Example 4

Except that the use amount of the polyethylene oxide (PEO-4 (trade name) manufactured by Sumitomo Seika Chemicals Company, Limited; weight average molecular weight: 1,300,000) was changed to 12.5 g from 2.5 g in Comparative Example 2, the same procedure as in Comparative Example 2 was carried out to obtain 512.5 g of a water-soluble metal working oil (content of polyethylene oxide: 2.4% by mass; viscosity: 261 mPa·s).

Comparative Example 5

Except that 5.0 g of the polyethylene oxide (PEO-1 (trade name) manufactured by Sumitomo Seika Chemicals Company, Limited; weight average molecular weight: 300,000) in Example 1 was changed to 2.5 g of a polyethylene oxide (PEO-1K1LZ (trade name) manufactured by Sumitomo Seika Chemicals Company, Limited; weight average molecular weight: 90,000), the same procedure as in Example 1 was carried out to obtain 502.5 g of a water-soluble metal working oil (content of polyethylene oxide: 0.5% by mass; viscosity: 3.2 mPa·s).

Comparative Example 6

Except that the use amount of the polyethylene oxide (PEO-1K1LZ (trade name) manufactured by Sumitomo Seika Chemicals Company, Limited; weight average molecular weight: 90,000) was changed to 5.0 g from 2.5 g in Comparative Example 5, the same procedure as in Comparative Example 5 was carried out to obtain 505.0 g of a water-soluble metal working oil (content of polyethylene oxide: 1.0% by mass; viscosity: 3.2 mPa·s).

Comparative Example 7

Except that the use amount of the polyethylene oxide (PEO-1K1LZ (trade name) manufactured by Sumitomo Seika Chemicals Company, Limited; weight average molecular weight: 90,000) was changed to 12.5 g from 2.5 g in Comparative Example 5, the same procedure as in Comparative Example 5 was carried out to obtain 512.5 g of a water-soluble metal working oil (content of polyethylene oxide: 2.4% by mass; viscosity: 8.2 mPa·s).

TABLE 1

| | Polyethylene oxide | | Mist scattering suppression efficiency | | | |
|---|---|---|---|---|---|---|
| | Content [% by mass] | Weight average molecular weight | — | Shearing processing for 2 minutes | Shearing processing for 10 minutes | Shearing processing for 15 minutes |
| Example 1 | 1.0 | 300,000 | 74 | 74 | 74 | 74 |
| Example 2 | 2.4 | 300,000 | 58 | 58 | 58 | 58 |
| Example 3 | 0.5 | 750,000 | 58 | 63 | 63 | 63 |
| Example 4 | 1.0 | 750,000 | 47 | 58 | 58 | 58 |
| Example 5 | 2.4 | 750,000 | 42 | 51 | 55 | 55 |
| Example 6 | 4.3 | 750,000 | 38 | 45 | 51 | 51 |
| Example 7 | 4.8 | 130,000 | 56 | 56 | 56 | 56 |
| Example 8 | 2.4 | 950,000 | 42 | 54 | 54 | 54 |
| Comparative Example 1 | — | — | 100 | 100 | 100 | 100 |
| Comparative Example 2 | 0.5 | 1,300,000 | 43 | 66 | 82 | 82 |
| Comparative Example 3 | 1.0 | 1,300,000 | 40 | 60 | 80 | 80 |
| Comparative Example 4 | 2.4 | 1,300,000 | — | — | — | — |
| Comparative Example 5 | 0.5 | 90,000 | 100 | 100 | 100 | 100 |
| Comparative Example 6 | 1.0 | 90,000 | 95 | 95 | 95 | 95 |
| Comparative Example 7 | 2.4 | 90,000 | 95 | 95 | 95 | 95 |

[Method for Evaluating Mist Scattering Suppression Efficiency]

(1) Mist Scattering Test

For evaluating mist scattering suppression efficiency for the water-soluble metal working oil, a mist scattering test was conducted using the following method for the water-soluble metal working oil obtained in each of Examples 1 to 8 and Comparative Examples 1 to 7. Using a device as shown in FIG. 1, the water-soluble metal working oil (test sample) was injected to a sheet of paper with an air blush (Air Blush High-Line HP-CH manufactured by ANEST IWATA Corporation; nozzle diameter: 0.3 mm). For test conditions, the spraying pressure of the device was 0.1 MPa, the liquid flow rate was 10 g/min, the distance between the air blush and the sheet of paper was 300 mm, the height of the air blush was 500 mm, and the injection amount of the test sample was 1 mL. The obtained results are shown in Table 1. The height of the air blush can be appropriately determined so that the circular shape formed on a sheet of paper by injecting the water-soluble metal working oil as a blank is confined within the sheet of paper. The symbol "-" in the column of "mist scattering suppression efficiency" in Table 1 means that the viscosity of the obtained water-soluble metal working oil was so high that the mist did not reach the sheet of paper, and thus it was unable to measure the scattering diameter.

(2) Evaluation of Mist Scattering Suppression Efficiency

Figure 2:
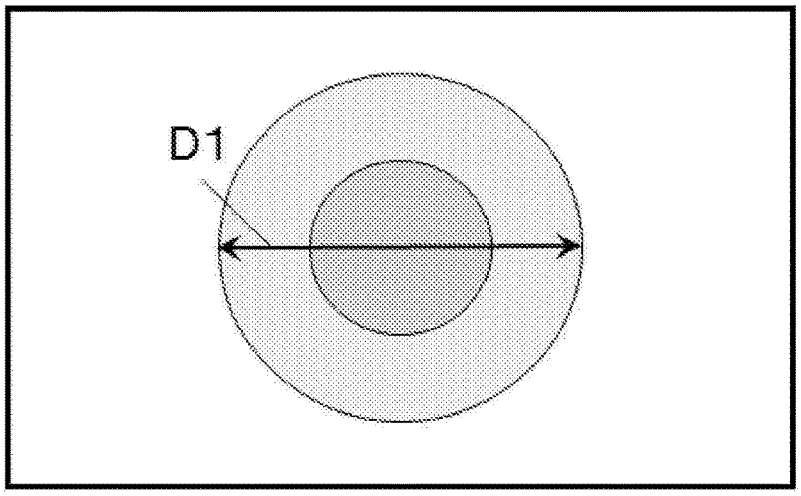
FIG. 2 is a schematic view for explaining a method for evaluation of the mist scattering suppression efficiency.
Figure 3:
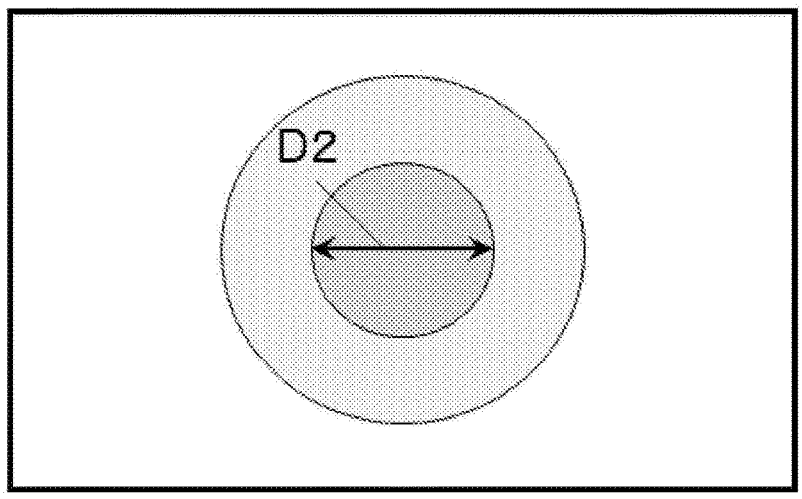
FIG. 3 is a schematic view for explaining a method for evaluation of the mist scattering suppression efficiency.

The spray pattern obtained in the mist scattering test described in (1) had a circular shape as shown in the schematic view of each of FIGS. 2 and 3. The mist scattering suppression efficiency was calculated using the following equation.

$$\text{Mist scattering suppression efficiency}=D_2/D_1\times 100$$

In the equation, $D_1$ denotes the diameter of a spray pattern that was formed by injecting the test sample of Comparative Example 1 which did not contain a polyethylene oxide (see FIG. 2). $D_2$ denotes the diameter of a spray pattern that was formed by injecting the test sample of each of Examples 1 to 8 and Comparative Examples 2, 3 and 5 to 7 (see FIG. 3). As described above, the test sample of Comparative Example 4 had such a high viscosity that a circular spray pattern was not formed. It can be determined that a lower value calculated from the equation shows a higher mist scattering suppression effect. The obtained results are shown in Table 1.

(3) Evaluation of Scattering Diameter and Mist Scattering Suppression Efficiency after Shearing Processing Shearing stress was applied under the following conditions to the test sample of each of Examples 1 to 8 and Comparative Examples 1 to 7. Shearing processing was performed by stirring the test sample at 15,000 rpm for 2 minutes using a homomixer (T.K. Homomixer Model Mark II 2.5 manufactured by TOKUSHU KIKA KOGYO CO., LTD.). The mist scattering suppression effect was evaluated in the same manner as described in (1) and (2) for the test sample after shearing processing for 2 minutes. The results are shown in Table 1. Similarly, the test sample obtained in each of Examples 1 to 8 and Comparative Examples 1 to 7 was subjected to shearing processing for 10 minutes and 15 minutes in the same manner as described above, and the mist scattering suppression effect was then evaluated for the test sample. The results are shown in Table 1.

From the results of Examples 1 to 8, it has become evident that a water-soluble metal working oil containing a polyethylene oxide having a weight average molecular weight of 100,000 to 1,000,000 has satisfactory mist scattering suppression efficiency, and retains mist scattering suppression efficiency even when shearing stress is applied for a long time.

The results of Comparative Example 1 are results of injecting a test sample which does not contain a polyethylene oxide as described above. From the results of Comparative Examples 2 to 3, it has become evident that when a polyethylene oxide having a weight average molecular weight of more than 1,000,000 is used, the mist scattering suppression efficiency in the early stage is satisfactory, but the suppression efficiency is easily affected by the time of applying shearing stress, so that the suppression efficiency is reduced as the time of applying shearing stress increases. From the results of Comparative Example 4, it has become evident that when the use amount of a polyethylene oxide having a weight average molecular weight of more than 1,000,000 is increased, the water-soluble metal working oil has such a high viscosity that it cannot be suitably used as a water-soluble metal working oil. Further, from the results of Comparative Examples 5 to 7, it has become evident that when a polyethylene oxide having a weight average molecular weight of less than 100,000 is used, the mist scattering suppression efficiency is low.

DESCRIPTION OF REFERENCE SIGNS

1: Air blush
2: Air
3: Mist of test sample
4: Paper

The invention claimed is:

1. A water-soluble metal working oil comprising a polyalkylene oxide having a weight average molecular weight of 300,000 to 1,000,000, a base oil and water, wherein a content of the polyalkylene oxide is 0.5 to 4.8% by mass, and wherein the polyalkylene oxide stably suppresses mist scattering of the water soluble metal working oil to a level of 74% or less, compared to an amount of mist scattering observed without inclusion of the polyalkylene oxide, over a period of at least 15 minutes during shearing.

2. The water-soluble metal working oil according to claim 1, wherein a carbon number of a monomer unit that forms the polyalkylene oxide is 2 to 4.

3. The water-soluble metal working oil according to claim 1, wherein the polyalkylene oxide comprises at least one monomer unit selected from the group consisting of an ethylene oxide unit, a propylene oxide unit and a butylene oxide unit.

4. The water-soluble metal working oil according to claim 1, wherein the polyalkylene oxide is at least one selected from the group consisting of a polyethylene oxide, a polypropylene oxide, a polybutylene oxide, an ethylene oxide-propylene oxide copolymer, an ethylene oxide-butylene oxide copolymer and a propylene oxide-butylene oxide copolymer.

5. The water-soluble metal working oil according to claim 1, wherein the viscosity is 5 to 10,000 mPa·s.

6. The water-soluble metal working oil according to claim 1, wherein the water-soluble metal working oil is used for cutting processing or grinding processing of a metallic material.

7. A method of processing a metal comprising contacting the water-soluble metal working oil according to claim 1 with a processing part of a metallic material and a processing tool.

8. The method according to claim 7, further comprising rotating the processing tool at a high speed while contacting the metallic material and the processing tool with the water-soluble metal working oil.

9. The method according to claim 7, wherein the processing comprises cutting of the metallic material and wherein the cutting processing is selected from the group consisting of machining processing, drilling processing, boring processing, milling processing and gear cutting processing.

10. The method according to claim 7, wherein the processing comprises grinding of the metallic material and wherein the grinding processing comprises internal grinding.

11. The method according to claim 7, wherein the metallic material is selected from the group consisting of iron, titanium, aluminum, magnesium, copper, nickel, chromium, manganese, molybdenum, tungsten, gold, silver, platinum and alloys containing at least one of the aforementioned metals.

12. A method for producing the water-soluble metal working oil according to claim 1, the method comprising mixing a polyalkylene oxide with water, wherein the polyalkylene oxide has a weight average molecular weight of 300,000 to 1,000,000, and mixing the polyalkylene oxide/water mixture with a general base oil, wherein a content of the polyalkylene oxide is 0.5 to 4.8% by mass, and wherein the polyalkylene oxide stably suppresses mist scattering of the water soluble metal working oil to a level of 74% or less, compared to an amount of mist scattering observed without inclusion of the polyalkylene oxide, over a period of at least 15 minutes during shearing.

* * * * *